US007487612B2

(12) United States Patent
Macaluso

(10) Patent No.: US 7,487,612 B2
(45) Date of Patent: Feb. 10, 2009

(54) GRENADE LAUNCHER

(75) Inventor: Tony Macaluso, Housse (BE)

(73) Assignee: FN Herstal S.A., Herstal (BE)

( * ) Notice: Subject to any disclaimer, the term of this patent is extended or adjusted under 35 U.S.C. 154(b) by 287 days.

(21) Appl. No.: 11/440,101

(22) Filed: May 25, 2006

(65) Prior Publication Data

US 2007/0068057 A1 Mar. 29, 2007

(30) Foreign Application Priority Data

May 31, 2005 (BE) ..... 2005/0272

(51) Int. Cl.
*F41A 3/12* (2006.01)

(52) U.S. Cl. ..... 42/10; 42/11; 42/12; 42/13

(58) Field of Classification Search ..... 42/105, 42/10–13; 89/1.34, 1.41
See application file for complete search history.

(56) References Cited

U.S. PATENT DOCUMENTS 50,760 A * 10/1865 Wheeler ..... 42/13
2,315,753 A * 4/1943 Long ..... 42/105
3,332,162 A 7/1967 Martwick et al.
3,507,067 A 4/1970 Into
3,557,482 A * 1/1971 Hoover ..... 42/12
3,641,691 A * 2/1972 Ellis et al. ..... 42/105
3,967,402 A * 7/1976 Cooksey ..... 42/10
3,967,403 A * 7/1976 Reynolds ..... 42/10
4,019,424 A * 4/1977 Reynolds ..... 89/137
4,061,075 A * 12/1977 Smith ..... 89/132
4,603,498 A * 8/1986 Johnson ..... 42/105
4,614,051 A * 9/1986 Thacker ..... 42/12
5,052,144 A * 10/1991 Ostor ..... 42/105
5,591,932 A * 1/1997 Staiert et al. ..... 89/33.03
5,837,920 A * 11/1998 Staiert et al. ..... 89/7
6,481,145 B2 * 11/2002 Weichert et al. ..... 42/105
2001/0042334 A1 * 11/2001 Weichert et al. ..... 42/105

* cited by examiner

*Primary Examiner*—Troy Chambers
*Assistant Examiner*—Jonathan C Weber
(74) *Attorney, Agent, or Firm*—Bacon & Thomas, PLLC

(57) ABSTRACT

A grenade launcher includes a frame, a barrel mounted on the frame and an opening mechanism. The opening mechanism includes a guide which enables advancement of barrel in a longitudinal direction of the frame and swiveling of the barrel laterally in the final phase of its longitudinal movement.

17 Claims, 9 Drawing Sheets

GRENADE LAUNCHER

FIELD OF THE INVENTION

The invention relates generally to grenade launchers.

BACKGROUND OF THE INVENTION

In a general manner, a grenade launcher comprises a frame with a percussion mechanism activated by a trigger; a barrel mounted on the frame; a locking mechanism for locking and unlocking the barrel in relation to the frame; an opening mechanism which makes it possible to open the grenade launcher so as to load and extract the ammunition; a handguard to hold the grenade launcher and to simultaneously activate said locking and opening mechanisms.

Generally, a grenade launcher also comprises an extraction device which enables the automatic extraction of a non-fired grenade or the case of a fired grenade out of the barrel chamber.

A grenade launcher of the type having a longitudinal opening with an opening mechanism by means of a movement of the barrel in the longitudinal direction of the grenade launcher is already known.

For this type of grenade launcher, the locking mechanism and the automatic extraction mechanism often have a relatively simple design and use.

Indeed, the automatic extraction mechanism may form a whole with the bolt face of the frame, whereas the locking mechanism may consist of a bayonet catch which is activated by the simple axial rotation of the barrel which is controlled for example by a simple longitudinal movement of the handguard.

In this case, the barrel is simply provided with locking lugs which fit in the front face of the frame of the grenade launcher. By rotating the barrel, the locking lugs are disengaged from the front face.

A disadvantage of a grenade launcher of the type with a longitudinal opening is that the choice of the ammunition is restricted, as the length of the grenades to be used is limited to more or less the opening distance of the grenade launcher.

A grenade launcher of the type having a lateral opening with a barrel that swivels laterally is already known as well.

This type of grenade launcher is advantageous in that longer ammunition can be used without being restricted by the opening distance of the grenade launcher, since the ammunition can be laterally loaded and extracted.

However, this type of grenade launcher is disadvantageous in that it has a complex design, due to the complexity of the locking mechanism, such that heavier embodiments are required, and due to the complexity of the specific extraction mechanisms for the case, which is so inconvenient that certain designers abandon an automatic extraction and settle for a manual extraction.

The invention aims to remedy one or several of the above-mentioned and other disadvantages and to provide a grenade launcher with a simple design which also makes it possible to use ammunition of any length whatsoever.

SUMMARY OF THE INVENTION

This aim is reached according to the invention with an improved grenade launcher which comprises a frame, a barrel mounted on the frame and an opening mechanism, characterised in that the opening mechanism comprises guiding means which make it possible to advance the barrel in the longitudinal direction of the frame and to make it swivel laterally in the final phase of its longitudinal movement.

In this manner, the ammunition can be laterally loaded in and extracted from the grenade launcher, which makes it possible to use ammunition of any length whatsoever.

Likewise, a grenade launcher according to the invention is characterised by an opening which is longitudinal in the first phase of the opening movement, which makes it possible to use opening mechanisms and locking mechanisms with a simple design.

The guiding means are preferably such that they make it possible to simultaneously advance and swivel the barrel in said final phase of the longitudinal movement of the barrel.

This allows for a faster complete opening movement. According to a preferred, relatively simple embodiment, the barrel is mounted in a handguard which comprises at least two sliding blocks which are mounted one after the other in the longitudinal direction of the handguard and which are mounted in a sliding manner between two longitudinal sliding guides parallel to the frame, one sliding block of which is mounted fixed to the handguard, whereas the other sliding block is mounted such that it can swivel in the lateral direction of the handguard.

BRIEF DESCRIPTION OF THE DRAWINGS

For clarity's sake, an example of an embodiment of an improved grenade launcher according to the invention is described hereafter by way of example only and without being limitative in any way, with reference to the accompanying drawings, in which.

DETAILED DESCRIPTION OF THE PREFERRED EMBODIMENTS

Figure 1:
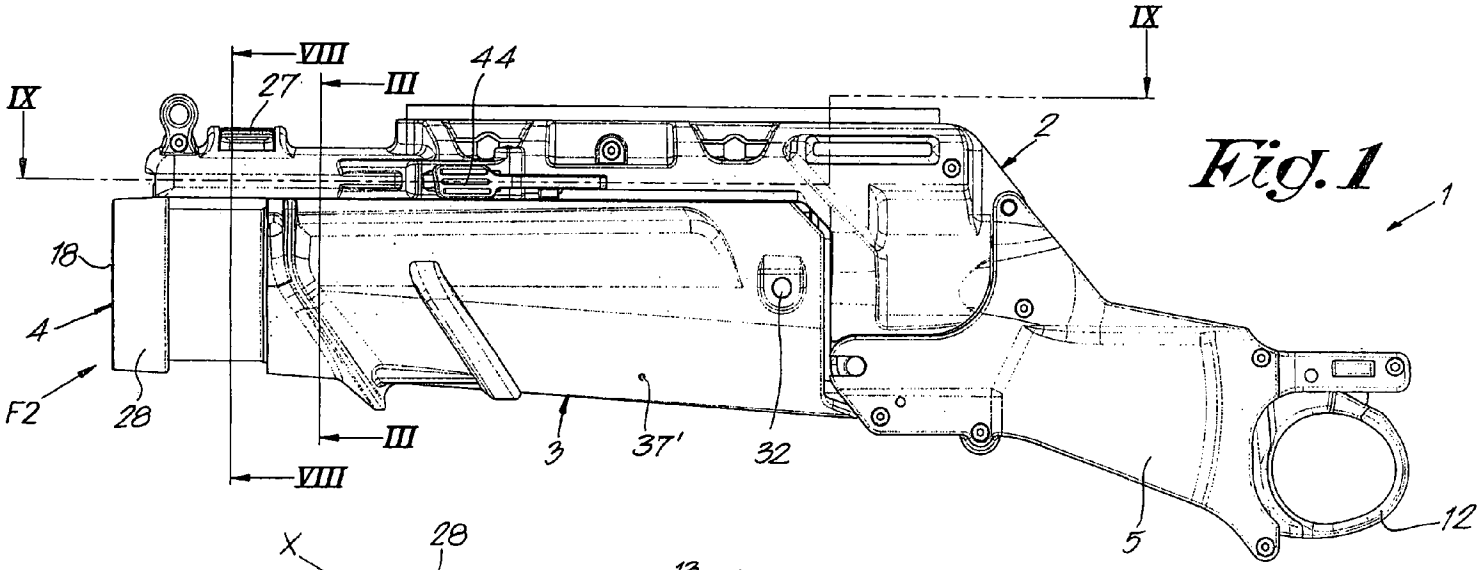
FIG. 1 is a schematic view of an improved grenade launcher according to the invention.

The improved grenade launcher 1 according to the invention as represented in the figures comprises a frame 2; a tubular handguard 3 mounted on the frame 2 and a barrel 4 held in a rotating and sliding manner in the handguard 3.

The frame 2 comprises a trigger housing 5 and a bolt 6 in which one extremity of the barrel 4 fits when the grenade launcher 1 is closed and whose front face 7 may support the ammunition which is loaded in the chamber 8 formed in the inserted extremity of the barrel 4.

A percussion mechanism 9 is incorporated in the frame 2 and comprises a firing pin 10 situated in a housing 11 in the front face 7 of the bolt 6.

The percussion mechanism 9 is controlled by a trigger 12.

The barrel 4 is fixed to the frame 2 by means of the handguard 3 which is suspended to the frame 2 in a sliding manner by means of two sliding blocks 13 and 14 which are mounted one after the other in the longitudinal direction X-X' of the handguard 3 and which are each inserted with edges 15 and 16 respectively in two parallel, longitudinal sliding guides in the form of two grooves 17 in the frame 2.

The sliding block 13 which is closest to the muzzle 18 of the barrel 4 is fixed to the handguard 3, whereas the other sliding block 14 which is farthest from the muzzle 18 of the barrel 4 is mounted in a laterally revolving manner on the handguard 3 by means of a central pivot 19.

Figure 6:
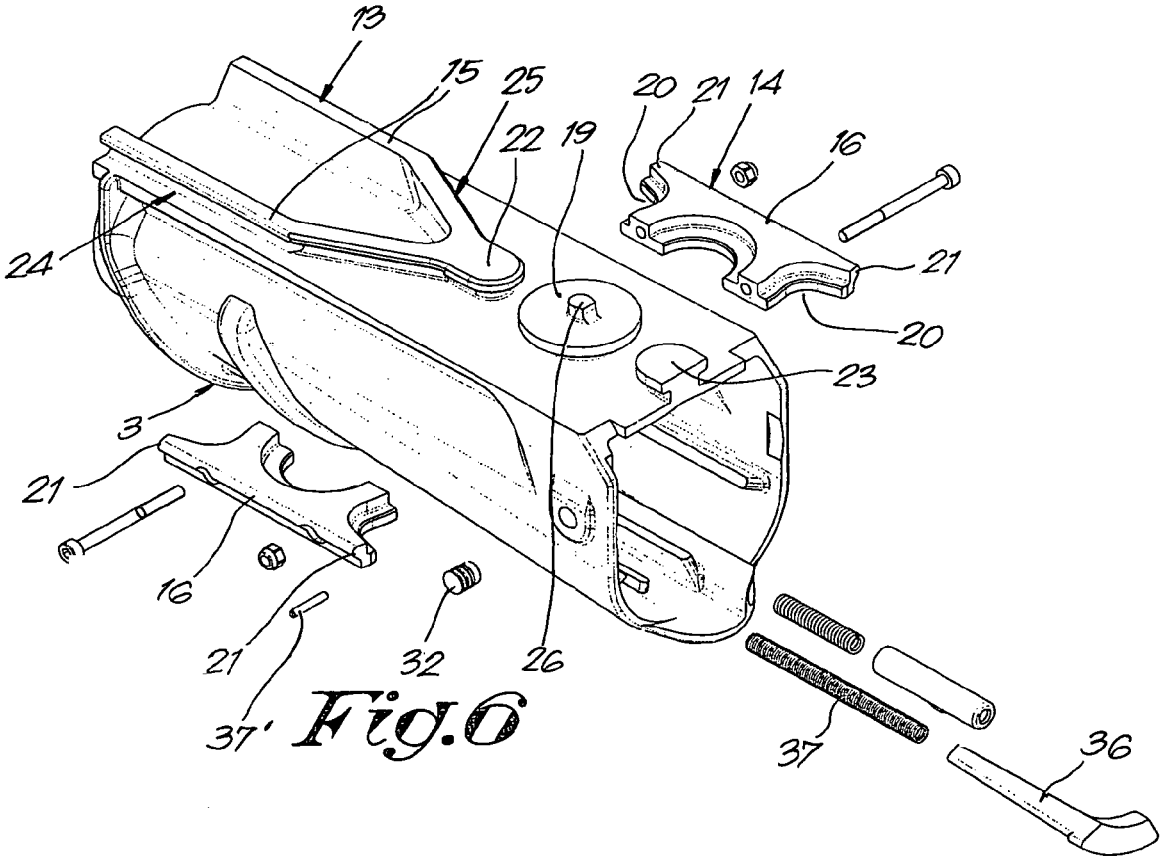
FIGS. 6 and 7 are exploded views of the parts indicated by F6 and F7 respectively in FIG. 2.
Figure 7:
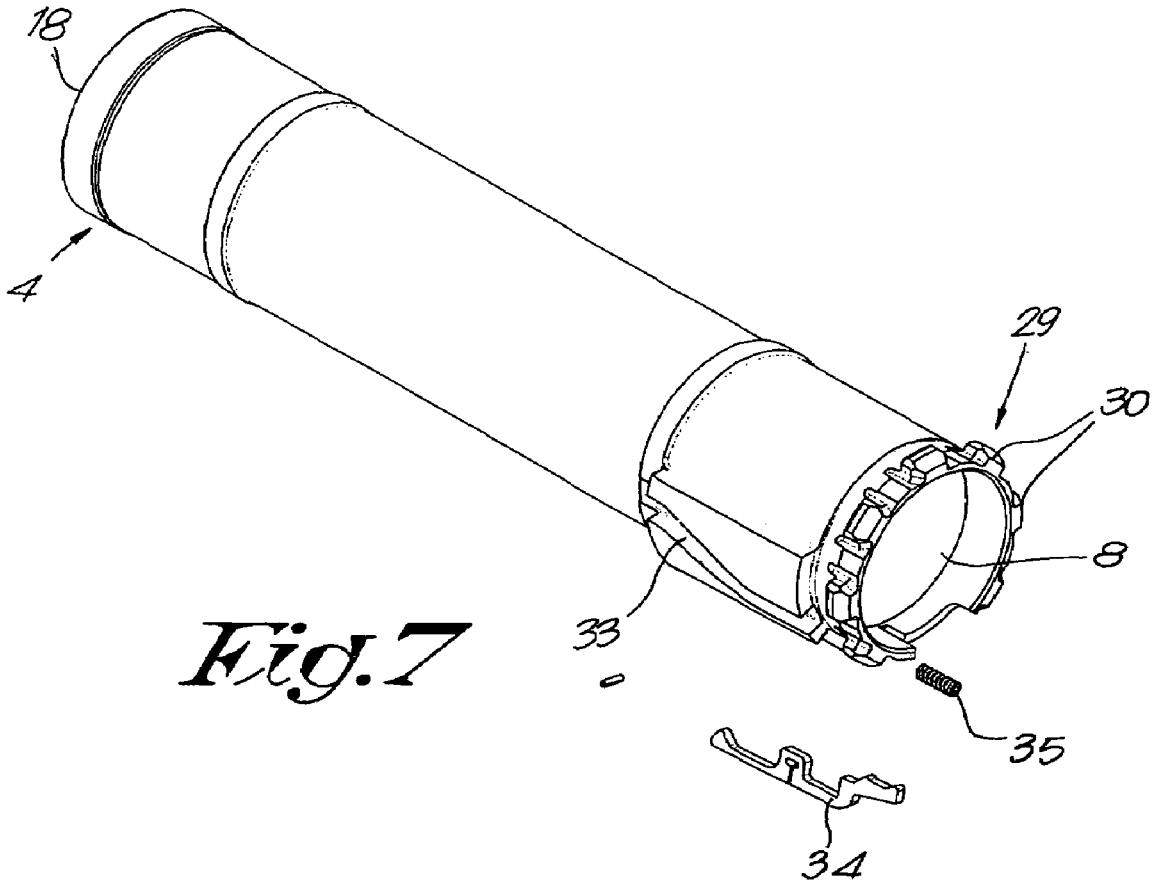
Figure 8:
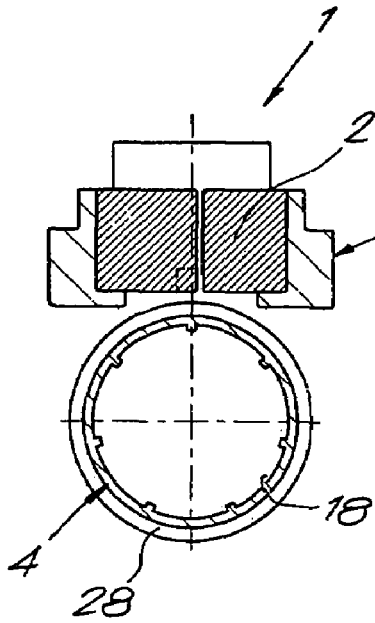
FIGS. 8 and 9 are sections according to line VIII-VIII and IX-IX respectively of FIG. 1.

As represented in FIG. 6, the revolving sliding block 14 is formed of two semi-circular pieces 20 which are assembled by means of screw bolts 21.

Figure 2:
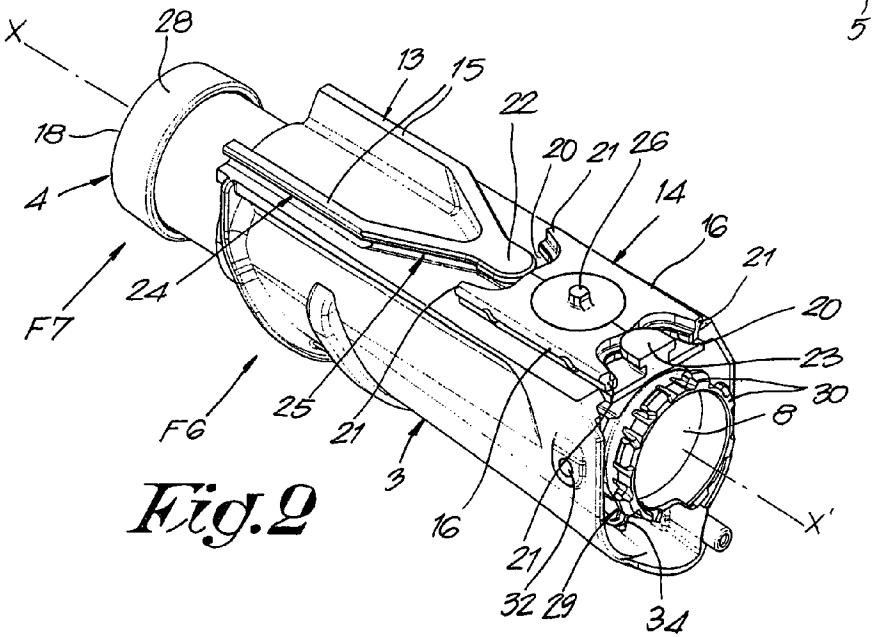
FIG. 2 shows the part indicated by F2 in FIG. 1 in perspective.
Figure 3:
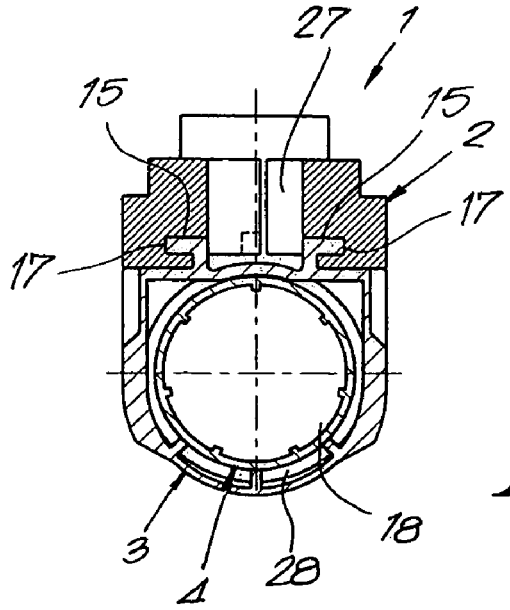
FIG. 3 is a cross section according to line III-III of FIG. 1.
Figure 4:
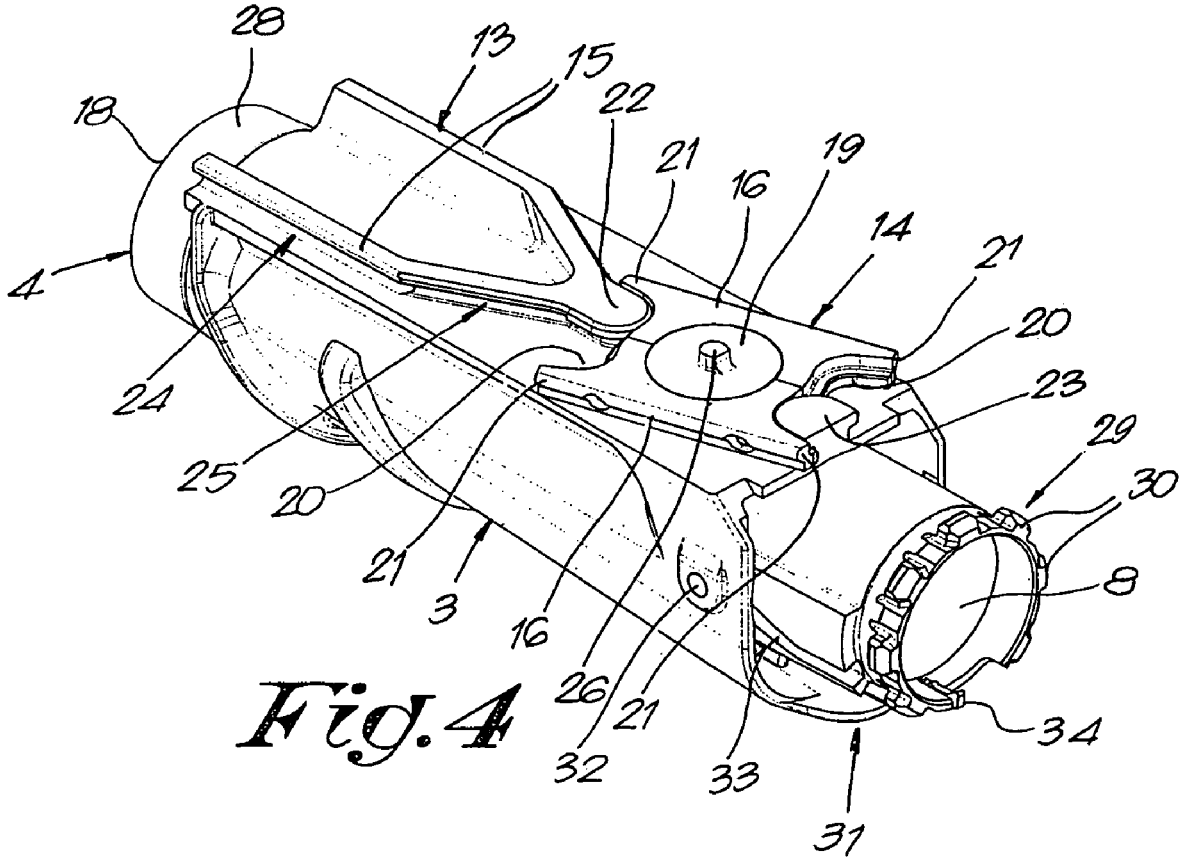
FIGS. 4 and 5 are views similar to those in FIG. 3, but in other positions.
Figure 5:
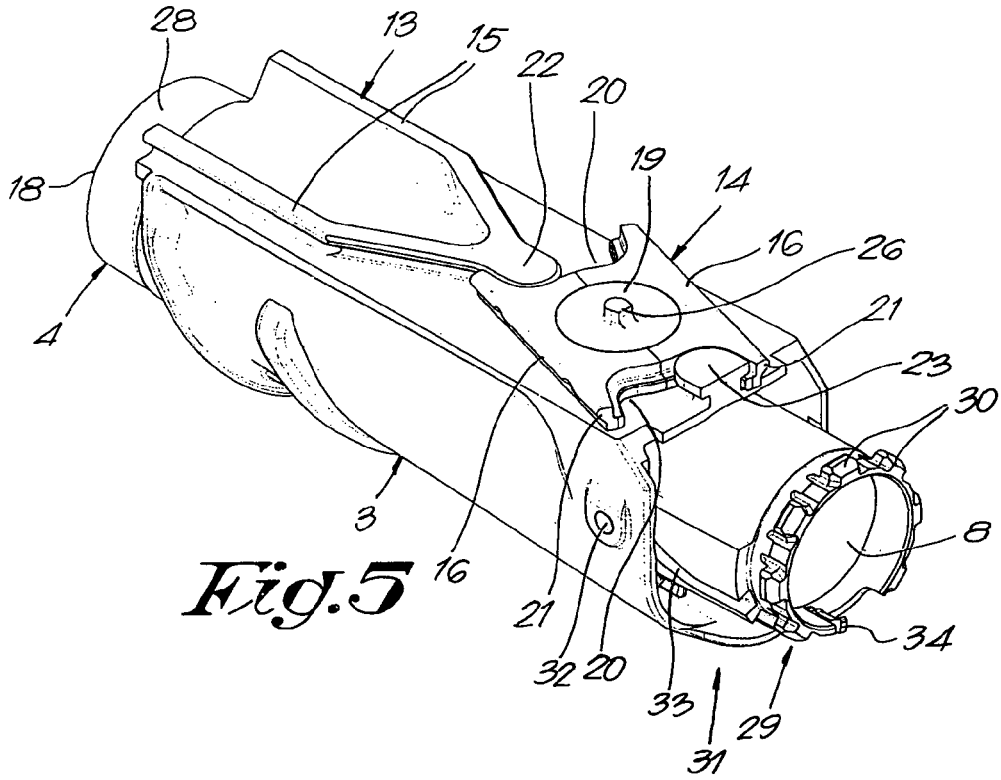

Each extremity of the revolving sliding block 14 is provided with a cavity forming a protrusion on each side which can work in conjunction with a centre swivel stop, 22 and 23 respectively, whereby each of the stops is situated in a cavity 20 and restricts the revolving course of the sliding block 14 round an average position as represented in FIG. 2, in which the sliding block 14 is longitudinally directed in relation to the longitudinal direction X-X' of the handguard 3 and between two extreme swivel positions as represented in FIGS. 4 and 5.

The fixed sliding block 13 comprises a straight part 24 which is situated at a distance from the revolving sliding block 14, as well as a part 25 formed of a narrowing conical extremity which extends in the longitudinal direction X-X' of the handguard towards the revolving sliding block 14.

The centre swivel stop 22 is formed of an extension of the conical part 25 of the fixed sliding block 13.

The handguard 3 is provided with a longitudinal end stop 26 which can work in conjunction with a corresponding end stop on the frame 2.

Both longitudinal end stops 26 and 27 are placed such that, when the grenade launcher is maximally opened in the longitudinal direction, the revolving sliding block 14 is still guided by the sliding guides 17 of the frame 2, whereas the straight part 24 of the fixed sliding block 13 protrudes entirely over the length of the sliding guides 17 and the conical part 25 of the fixed sliding block 13 protrudes over a certain distance of the length of said sliding guides 17.

To this end, the longitudinal end stops 26 and 27 are placed on the pivot 19 of the handguard 3 and at the front extremity of the frame 2 respectively.

In this case, the stop 27 can be withdrawn or raised so as to dismount the handguard 3 from the frame 2.

The barrel 4 is mounted in the handguard 3 in a sliding and rotating manner.

An annular stop 28 at the muzzle 18 of the barrel 4 restricts the relative longitudinal movement of the barrel 4 in the handguard 3.

At the opposite extremity of the muzzle 18, the barrel 4 is provided with a bayonet catch 29, formed of lugs 30 which can fit as said extremity of the barrel 4 is inserted in the bolt 6, followed by a rotation of the barrel 4 so as to close the chamber 8 of the barrel 4 and to lock the barrel 4 on the frame 2.

The grenade launcher 1 is provided with means 31 which allow for an automatic control of the axial rotation of the barrel 4 by means of a longitudinal movement of the handguard 3 so as to be able to lock and unlock the barrel 4 when the handguard 3 is moved over a certain distance in the longitudinal direction in relation to the frame 2.

In the example given in the figures, said means 31 are formed of a wedge going through the wall of the handguard 3 so as to form a protuberance 32 of the handguard 3 which is guided in a slanting groove 33 inside the barrel 4, whereby the groove 33 forms an angle with the longitudinal direction X-X'.

The barrel 4 is equipped with a brake 34 in the form of a tilting element which, thanks to the action of the spring 35, exerts a light radial force on the case of a grenade which may be present in the chamber 8 of the barrel 4, so that the case will be lightly held up in the chamber 8 when the grenade launcher is opened.

In order to secure the position of the axial rotation of the barrel 4 after it has been unlocked, a barrel plunger 36 is mounted in the handguard 3, whereby the plunger 36 is controlled by a spring 37 retained by a pin 37'.

Optionally, the grenade launcher 1 can be provided with an automatic extraction device for the ammunition with an extractor 38 in the form of a revolving hook which is mounted in the seat 6 of the frame 2.

The extractor 38 is controlled by a spring 39 which catches the collar of the case of a grenade present in the chamber 8 of the barrel 4, so that the case can be held against the face 7 of the bolt 6 when the grenade launcher 1 is opened.

The extractor 38 is provided with a lever 40 which makes it possible to make the extractor 38 swivel against the action of the spring 39, so that the extractor 38 can be made inactive.

In the same manner, the grenade launcher 1 can be provided with an ejector 41 mounted in the front face 7 of the bolt 6 and controlled by a spring 42 so as to exert an axial force on the case of the grenade.

The working and use of the grenade launcher 1 according to the invention are simple and as follows.

Figure 9:
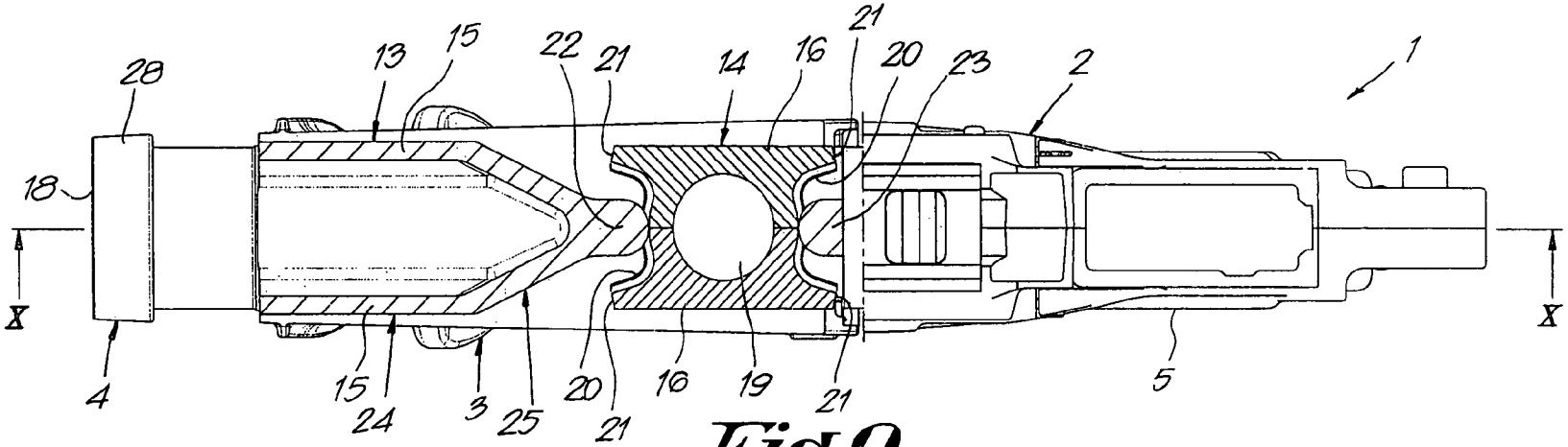
Figure 10:
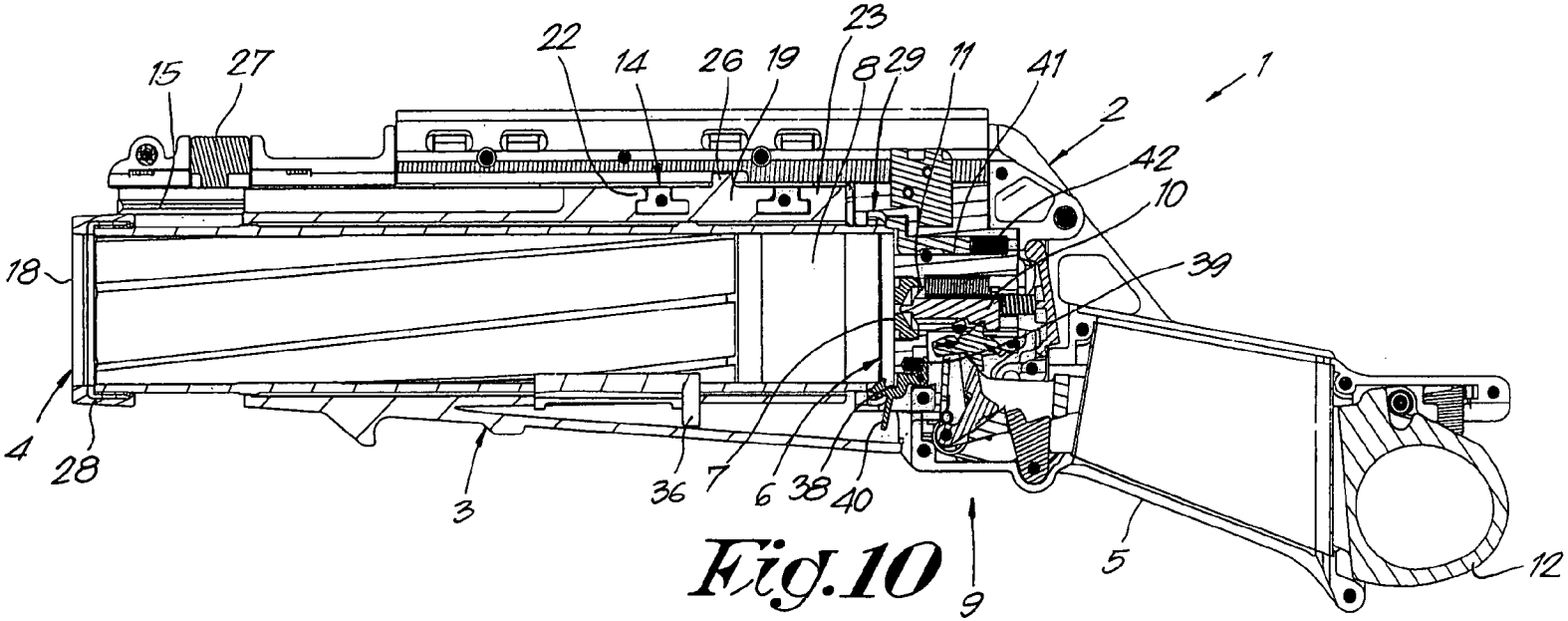
FIG. 10 is a section according to line X-X in FIG. 9.

FIGS. 1, 9 and 10 represent the grenade launcher 1 in its closed position after a grenade has been fired and an empty case 3 is situated in the chamber 8 of the barrel 4, maintained against the front face 7 by the extractor 38.

In order to open the grenade launcher 1, the user activates the unlocking key 44 of the handguard 3 in relation to the barrel 4 and pushes the handguard 3 forward, which, in the first few millimeters, makes the barrel 4 rotate round its axis, guided by the protuberance 32 of the handguard 3 in the slanting groove 33 of the barrel 4, such that the barrel 4 is unlocked as the lugs 30 are released from the bolt 6.

Next, thanks to the presence of the stop 28 at the muzzle 18 of the barrel 4, the longitudinal movement of the handguard 3 also causes the barrel 4 to move longitudinally, while its axial orientation is preserved.

Figure 11:
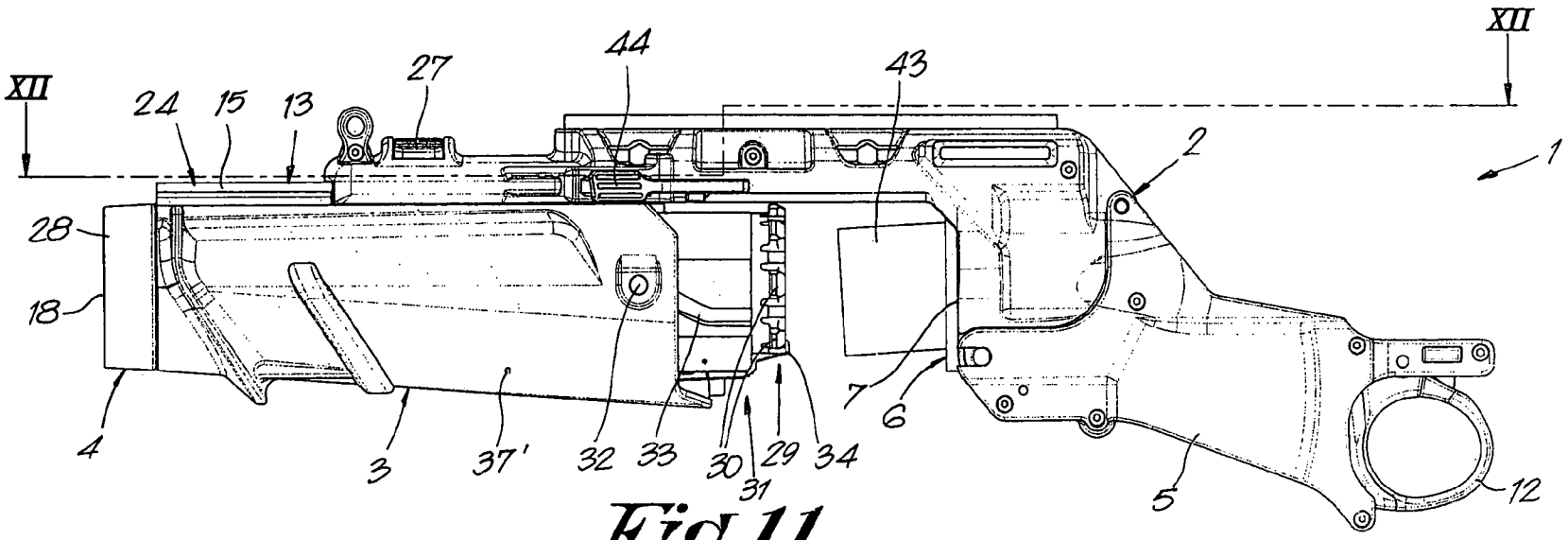
FIG. 11 is a view similar to that in FIG. 1, but for a partially opened position of the grenade launcher.
Figure 13:
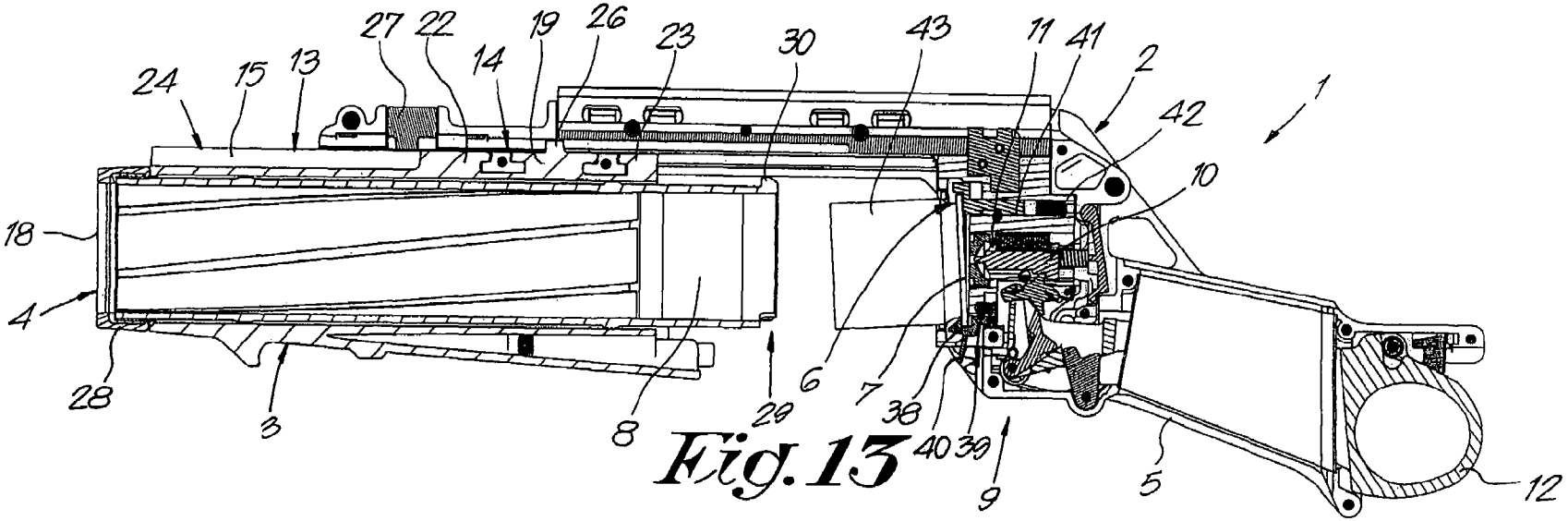
FIG. 13 is a section as that in FIG. 10, but for a position corresponding to FIG. 11.

During said movement of the barrel 4, the case 43 is being retained against the front face 7 and it is ejected downward as soon as it has entirely left the chamber 8 through the effect of the ejector 41 as represented in FIGS. 11 and 13.

During said movement, the handguard 3 is forced to follow a longitudinal trajectory, as the two sliding blocks of the handguard 3 are guided in the sliding guides 17 of the frame 2.

Figure 12:
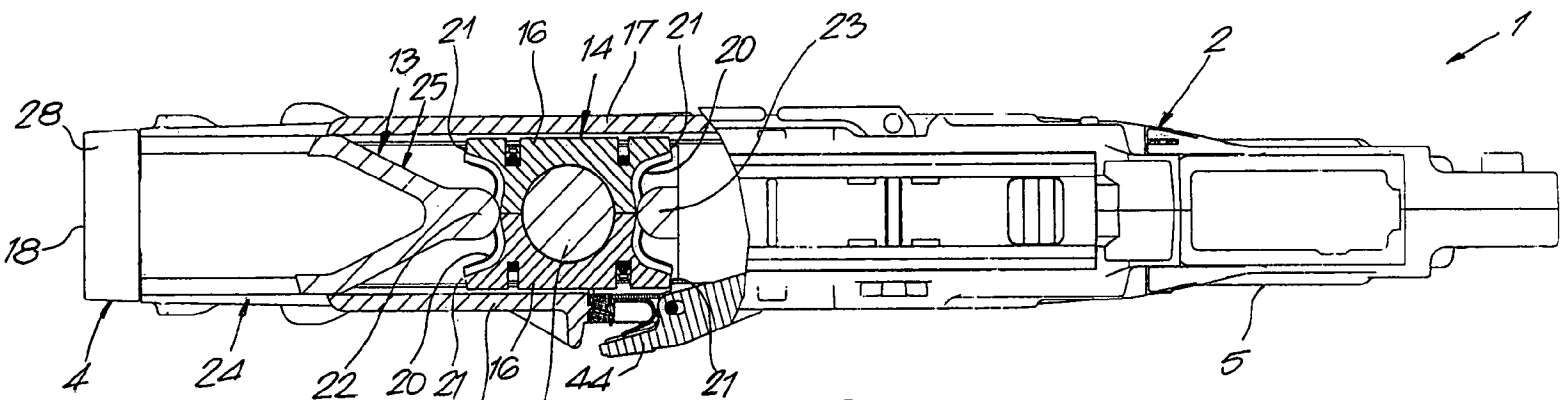
FIG. 12 is a section according to line XII-XII of FIG. 11.

As of the position represented in FIGS. 11 and 13, the fixed sliding block 13 leaves the sliding guides 17 as shown in FIG. 12 and thus makes it possible for the handguard 3 and the barrel 4 to laterally swivel round the pivot 19 as a result of the revolving motion of the sliding block 14.

Figure 14:
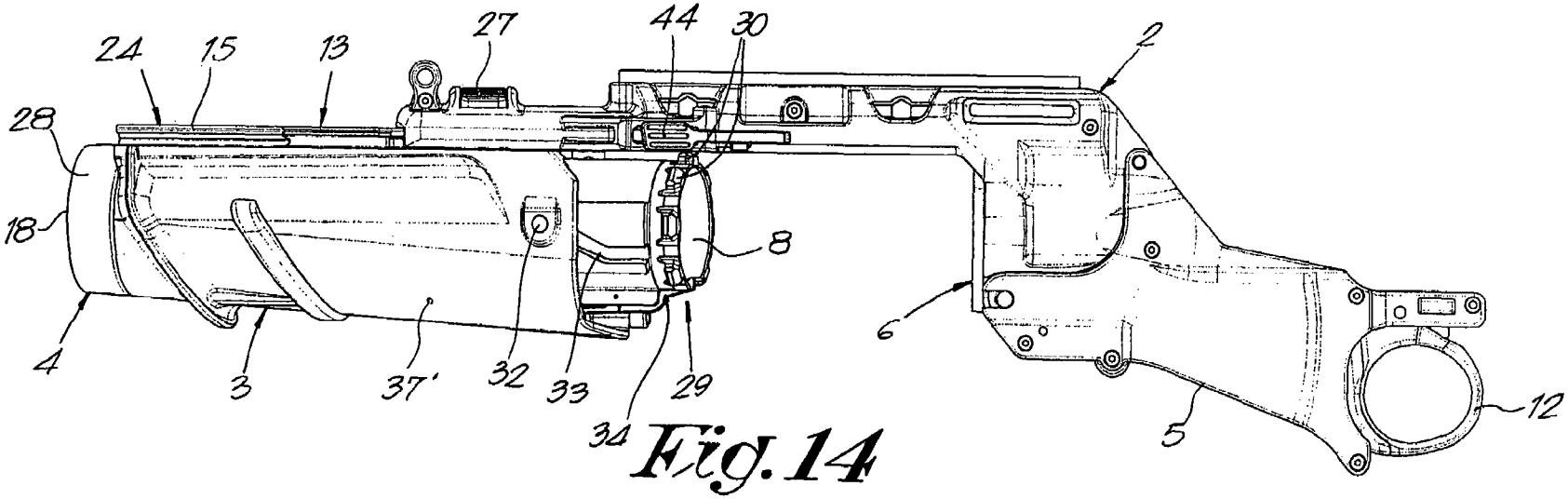
FIGS. 14 and 16 are views similar to those in FIG. 11, but for larger openings and after the ammunition has been ejected.
Figure 15:
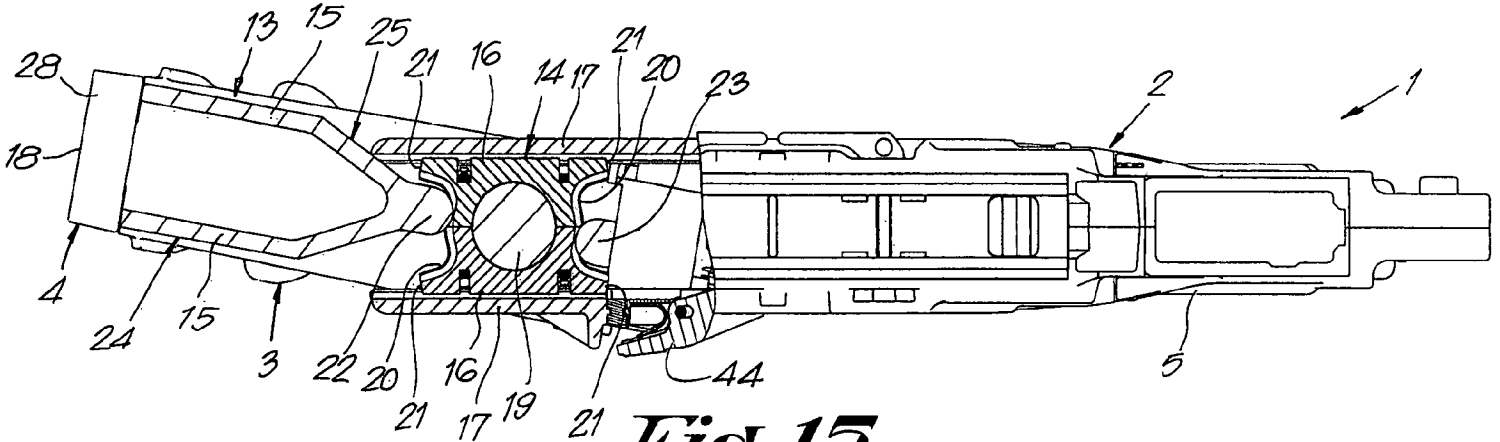
FIGS. 15 and 17 are sections as those in FIG. 12, but for the positions of FIGS. 13 and 15 respectively.

As represented in FIGS. 14 and 15, the lateral rotation is restricted in that the conical part 25 of the fixed sliding block 13 comes to a stop against the front extremity of one of the sliding guides 17, depending on whether the handguard 3 swivels to the left or to the right.

Figure 16:
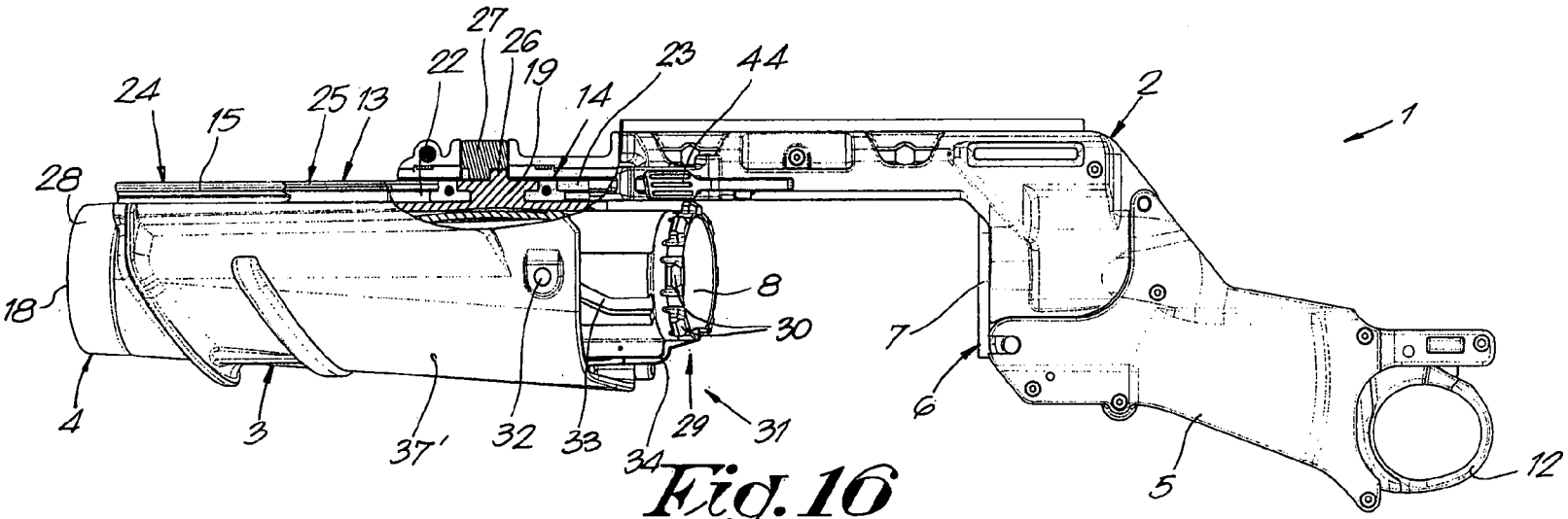
Figure 17:
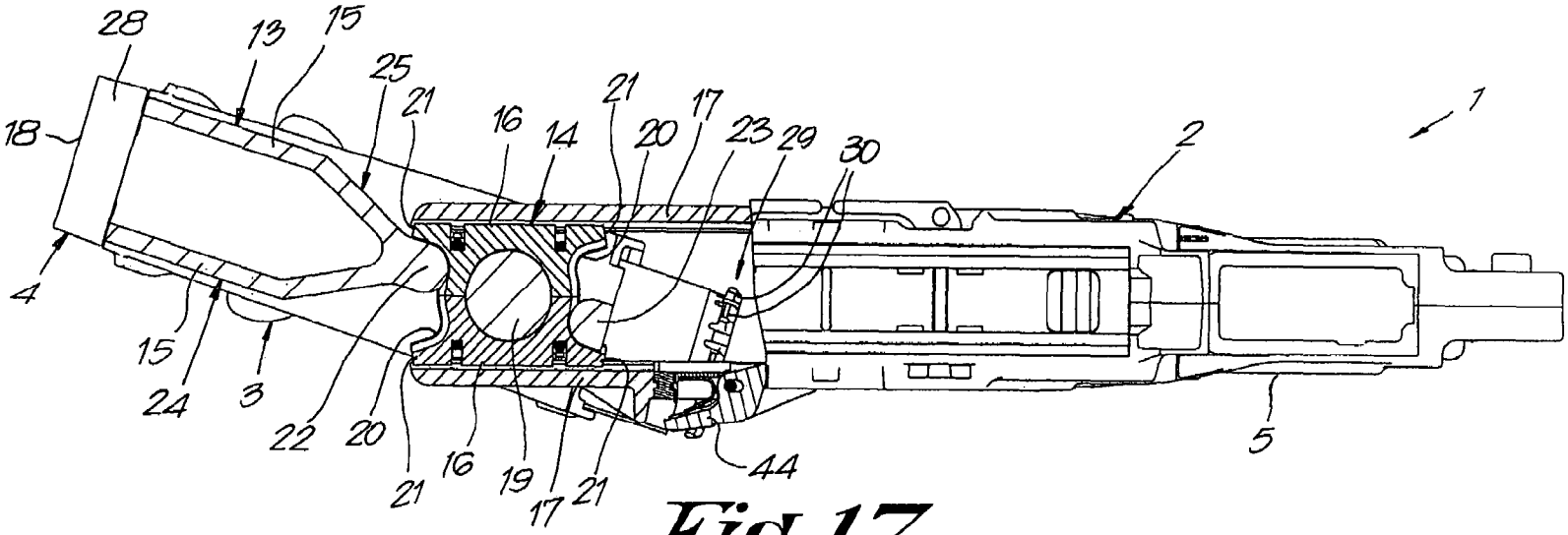

Thus, the rotation of the handguard 3 is progressively guided up to a maximal lateral opening as represented in FIGS. 16 and 17, and it is restricted by the presence of the stops 25 and 23.

As the lateral movement of the conical part 25 is guided by the fixed sliding block 13, this allows for a gradual and progressive opening movement of the grenade launcher 1.

Since the barrel 4 has now swivelled laterally, the selection of a new grenade to be loaded is not restricted by the opening distance of the grenade launcher 1.

Figure 18:
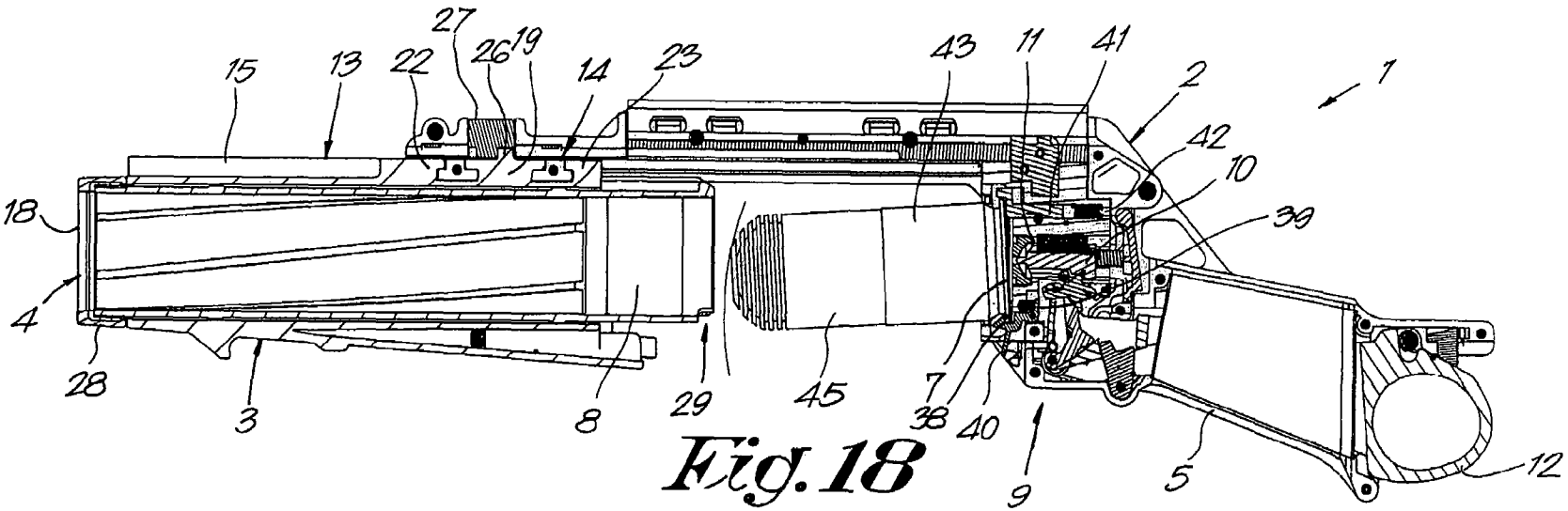
FIG. 18 is a section as that of FIG. 10, but with non-fired ammunition.

In the case of a grenade 45 whose length is shorter than the opening distance of the grenade launcher 1, the non-fired grenade can be extracted by means of an automatic extraction device as represented in FIG. 18.

In case of a longer grenade, the automatic extraction device can be put out of action by pushing the lever 40 of the extractor 38 as the grenade launcher 1 opens. In that case, the non-fired grenade is maintained in the chamber 8 of the barrel 4 thanks to the brake 34, and the grenade can then be manually extracted into a lateral revolving position of the barrel 4.

It is clear that the grenade 45 can be loaded and extracted on the left side as well as on the right side of the grenade launcher 1, which has for a result that the grenade launcher according to the invention is useful to a left-hand user as well as a right-hand user.

It is clear that the invention is by no means limited to the example described above, but that numerous modifications can be made to the improved grenade launcher while still remaining within the scope of the invention as defined in the following claims.

The invention claimed is:

1. A grenade launcher, comprising a frame, a barrel mounted on the frame and an opening mechanism, wherein the opening mechanism comprises guiding means arranged to enable advancement of the barrel along a longitudinal direction of the frame and swiveling of the barrel laterally in a final phase of its longitudinal movement.

2. The grenade launcher according to claim 1, wherein the guiding means is arranged to cause the barrel to simultaneously advance and laterally swivel in said final phase of the longitudinal movement.

3. The grenade launcher according to claim 1, wherein the barrel is mounted in a handguard having at least first and second sliding blocks mounted one after another in a longitudinal direction of the handguard and in a sliding manner between two parallel longitudinal sliding guides of the frame, wherein the first sliding block is fixed to the handguard and the second sliding block is laterally mounted in a revolving manner on the handguard.

4. The grenade launcher according to claim 3, wherein said barrel includes a muzzle, and the second sliding block is farther from the muzzle than the first sliding block.

5. The grenade launcher according to claim 3, wherein the second sliding block is arranged to swivel round an average position in which the sliding block is longitudinally directed in relation to the longitudinal direction of the handguard.

6. The grenade launcher according to claim 3, wherein a course of the second sliding block is restricted by at least one swivel stop.

7. The grenade launcher according to claim 6, wherein the at least one swivel stop is situated in a cavity at an end portion of the second sliding block.

8. The grenade launcher according to claim 3, wherein the first sliding block has a straight part situated at a distance from the second sliding block and a conical part formed of a narrowing end portion which extends in the longitudinal direction of the handguard towards the second sliding block.

9. The grenade launcher according to claim 7, wherein the swivel stop is formed of an extension of a conical part of the first sliding block.

10. The grenade launcher according to claim 8, wherein the handguard has a first longitudinal end stop which cooperates with a corresponding second longitudinal end stop on the frame.

11. The grenade launcher according to claim 10, wherein the longitudinal end stops are located such that, when the grenade launcher is maximally opened in the longitudinal direction, the second sliding block is still guided by the sliding guides and, the conical part of the first sliding block protrudes over a certain distance of the length of said sliding guides.

12. The grenade launcher according to claim 10, wherein the longitudinal end stops are placed such that, when the grenade launcher is maximally opened in the longitudinal direction, the second sliding block is still guided by the sliding guides and, the straight part of the first sliding block protrudes entirely over the length of the sliding guides.

13. The grenade launcher according to claim 10, wherein the first and second longitudinal end stops are placed on a pivot of the handguard and at an end portion of the frame, respectively.

14. The grenade launcher according to claim 1, wherein the barrel has a bayonet catch rotating lock and the grenade launcher further comprises means enabling an automatic control of an axial rotation of the barrel by means of a longitudinal movement of the handguard so as to enable locking and unlocking of the barrel when the handguard is moved over a certain distance in the longitudinal direction in relation to the frame.

15. The grenade launcher according to claim 14, wherein the means which enables automatic control of the axial rotation of the barrel comprises a protuberance of the handguard which is guided in a slanting groove in the barrel forming an angle to the longitudinal direction of the handguard.

16. The grenade launcher according to claim 1, further comprising an automatic extraction device including an extractor mounted on the frame.

17. The grenade launcher according to claim 16, wherein the extractor is provided with a lever enabling inactivation of the extractor while the grenade launcher is being opened.

* * * * *